US005380093A

United States Patent [19]

Goldman

[11] Patent Number: 5,380,093

[45] Date of Patent: Jan. 10, 1995

[54] VEGETABLE DRAINING AND STORAGE BAG

[76] Inventor: Robert I. Goldman, 6658 Cibola Rd., San Diego, Calif. 92120

[21] Appl. No.: 136,900

[22] Filed: Oct. 18, 1993

[51] Int. Cl.[6] ..... B65D 30/22; B65D 33/01

[52] U.S. Cl. ..... 383/38; 210/464; 210/466; 383/100; 383/906

[58] Field of Search ..... 383/38, 40, 100, 101, 383/103, 904, 906; 210/244, 464, 466, 477

[56] References Cited

U.S. PATENT DOCUMENTS

| | | | |
|---|---|---|---|
| 1,251,404 | 12/1917 | Mills | 383/40 |
| 2,001,149 | 5/1935 | Monshein | 383/103 |
| 2,163,324 | 6/1939 | Reinhold | 383/103 |
| 2,688,914 | 9/1954 | Eckler | 383/103 |
| 2,789,728 | 4/1957 | Britton | 383/906 |
| 2,998,340 | 8/1961 | Conway et al. | 383/904 |
| 3,159,096 | 12/1964 | Tocker | 383/103 |
| 3,171,581 | 3/1965 | Kugler | 383/904 |
| 3,224,586 | 12/1965 | Wade | 210/477 |
| 4,503,559 | 3/1985 | Warnke | 383/40 |

FOREIGN PATENT DOCUMENTS

| | | | |
|---|---|---|---|
| 926657 | 5/1963 | United Kingdom | 383/100 |

*Primary Examiner*—Stephen P. Garbe

*Attorney, Agent, or Firm*—Henri J. A. Charmasson; John D. Buchaca

[57] ABSTRACT

An inexpensive, collapsible, disposable and sealable bag for draining and storing washable goods such as salad vegetables which includes a main storage chamber dimensioned to accept the washable goods of interest, a reservoir positioned beneath the storage chamber and connected to the storage chamber through a series of apertures. When the user revolves the bag, the excess water is driven down away from the washable goods through the apertures and into the reservoir. A channel extending up the side of the bag provides a means for draining the reservoir prior to sealing the bag for storage.

13 Claims, 1 Drawing Sheet

VEGETABLE DRAINING AND STORAGE BAG

FIELD OF THE INVENTION

This invention relates to devices for draining and storing washable goods and more particularly to devices for removing excess water from salads and storing salads.

BACKGROUND OF THE INVENTION

Salad spinners are well-known devices for removing excess water from washable goods such as vegetables. Many operate using the same principle employed in clothes washers . The device typically comprises a cylindrical container with holes through the walls into which is placed the washable material . After rinsing, excess water or other cleaning fluid is removed by spinning the container, subjecting the contents to centrifugal forces. This forces the water to the periphery of the container where it slips through the holes.

Since these devices spin at a relatively high angular velocity, the structure of the container is usually constructed of a strong, rigid material such as metal or plastic so that it will maintain its circular shape while spinning and not wobble. This rigid, non-collapsible container structure, even if removable from the spinning mechanism, is quite bulky. When used for storage, it takes up a considerable amount of the limited room available in a refrigerator or in its vegetable drawer.

The storage of vegetables in an air-tight environment is also desirable to maintain their freshness. Typical salad spinners are not air-tight and therefore unsuitable for storing vegetables long-term. An alternative is removing the salad from the spinner and storing the salad in the refrigerator in a plastic bag. This can be inconvenient. In general, typical salad spinners do not provide a practical refrigerated vegetable storage receptacle.

Salad spinners are relatively expensive. They generally require additional mechanisms and/or attachments for implementing the spinning feature. This necessarily adds to the intricacy and therefore, expense of the overall product. Because of their relative expense, current salad spinners are not economically disposable. Disposability of a storage container for sanitary and convenience reasons is still an asset with today's consumers who are still tenaciously grasping onto the "throw-away" mentality.

It would be desirable therefore, to have a device which drains excess water from washable goods and which stores them in a disposable collapsible airtight container.

SUMMARY OF THE INVENTION

The principal and secondary objects of this invention are to provide a simple, inexpensive, collapsible and disposable device for draining and storing washable goods.

These and other objects are achieved by a bag having a storage chamber dimensioned to accept the washable goods of interest, a reservoir positioned beneath the storage chamber and connected to the storage chamber through a series of apertures. When the user revolves the bag, the excess water is driven down away from the washable goods through the apertures and into the reservoir. A channel extending up the side of the bag provides a means for draining the reservoir prior to sealing the bag for storage.

BRIEF DESCRIPTION OF THE DRAWING

FIG. 2 is a transparent depiction of the bag having a sealing means built in.

DESCRIPTION OF THE PREFERRED EMBODIMENT OF THE INVENTION

Figure 1:
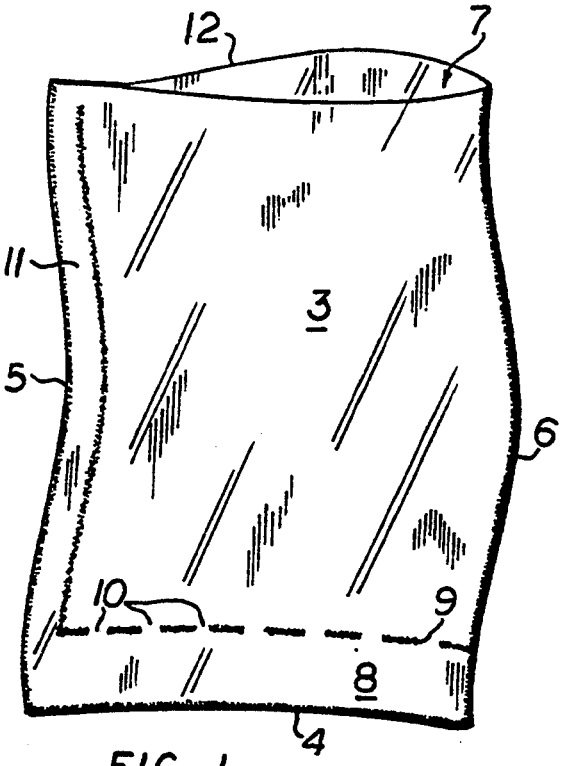
FIG. 1 is a transparent depiction of the bag.

Referring now to the drawing, FIG. 1 shows a draining and storage bag made of a pliable, non-soluble sheet material such as plastic. The bag has a main storage chamber 3 formed by two substantially planar and substantially parallel sheets which are connected along three sides, the bottom 4, and two lateral edges 5 and 6 leaving an opening 7 at the top of the bag. The main storage chamber 3 is sized and dimensioned to accept the washable goods of interest. Adjacent to the chamber is a reservoir 8 for collecting fluids being drained from the goods in the chamber. The reservoir is separated from the chamber by a fluid permeable barrier 9. In this case the barrier is formed by an intermittent seal having a plurality of apertures 10 sized and dimensioned to allow passage of fluid therethrough connecting the chamber to the reservoir. Once the excess fluid is located in the reservoir it may be drained from the reservoir through a channel 11 positioned adjacent to the chamber and running from the reservoir up to the top of the bag.

In order to drive the excess fluid down into the reservoir, the user can grasp the top 12 of the bag an revolve it in a circular motion, thereby generating centrifugal forces on the contents.

A typical sequence which utilizes the bag involves the user placing pre-washed or unwashed goods into the chamber. The user may then add a washing fluid such as water to the main storage chamber of the bag, close off the top with the squeeze of a hand or by other means and agitate it, thereby washing the goods. The user then grasps a portion of the bag near the top and revolves the bag in a lasso-type motion, thereby driving the fluid from the chamber through the apertures into the reservoir by centrifugal force. The user then tips the bag on end with the channel side down, thereby pouring the fluid from the reservoir through the channel and out the top of the bag. The user may then collapse the bag around the goods thereby driving out any excess air in the bag, then seal the top of the bag to provide a substantially airtight container for storing in a refrigerator.

An advantage of this product is that it can be made very inexpensively using a single stamping and heat sealing process which is ordinarily used to create plastic bags. The seals forming the edges of the bag and boundaries between the chamber and the reservoir and between the chamber and the channel can be formed at the same time as when the bag is cut from two parallel sheets of plastic that are run together in a face-to-face configuration. Alternatively, the material used to form the bag may consist of one sheet of folded, laminated plastic.

Figure 2:
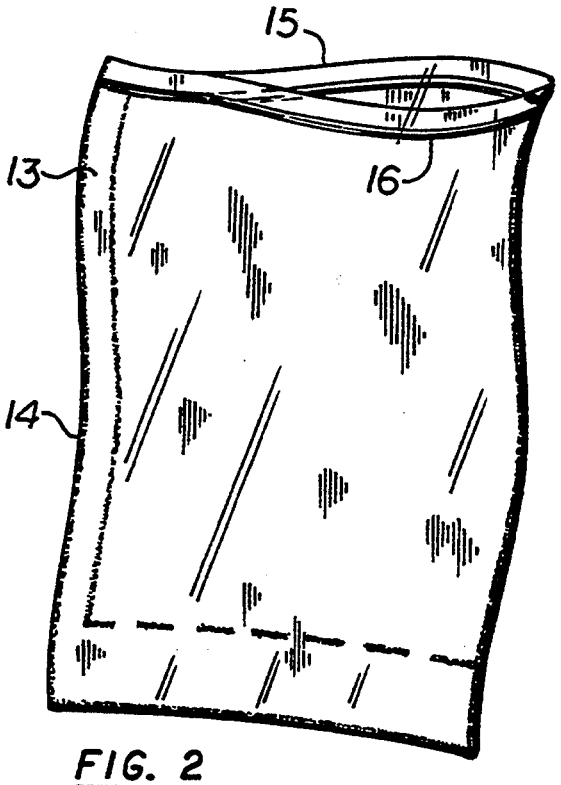

In an alternate embodiment as seen in FIG. 2, the top 13 of the channel 14 at the top of the bag terminates just below the top edge 15 of the bag so that a single tongue and groove releasable locking strip 16 such as those sold under the brand name ZIPLOCK may be used to seal the top of the bag. Other embodiments may provide other means for evacuating fluid from the reservoir such as a spout or a sealable open bottom end. Other embodiments may provide alternate means for sealing the top of the bag. These include attached or unattached wire twist ties, plastic belts or clasps, cinch-tops and bread-style plastic chokers and many other means well known in the art.

While the preferred embodiments of the invention have been described, modifications can be made and other embodiments may be devised without departing from the spirit of the invention and the scope of the appended claims.

What is claimed is:

1. A device for draining vegetables and other washable goods which comprises:

a bag made of a pliable sheet material, said bag defining a chamber having an open top and a sealed bottom and sealed lateral edges;

a reservoir formed along the bottom edge and separated from the chamber by a permeable barrier; and means for draining a fluid from said reservoir;

wherein said means draining comprises a channel running from said reservoir toward said open top and terminating at an end located a distance above said permeable barrier.

2. The device of claim 1, which further comprises:

means for releasably sealing said open top.

3. The device of claim 1, wherein said channel is defined along one of the lateral edges of the bag.

4. The device of claim 3, wherein said end terminates a distance from said top opening of said bag.

5. The device of claim 3, wherein said reservoir and said channel are integral with said bag.

6. The device of claim 5, wherein the material used to form said bag comprises plastic.

7. The device of claim 6, wherein the material used to form said bag consists of one sheet of folded, laminated plastic.

8. A bag for draining and storing food comprising:

first and second substantially planar sheets having substantially the same dimensions;

said first and second sheets positioned in a parallel, face-to-face configuration;

said sheets connected along a common bottom, along a common first side, along a common second side, and not permanently connected along a common top;

a first connection between said first and second sheets extending vertically along and parallelly spaced apart from said first side, said first connection having an upper end terminating at a first distance away from said top, said first connection having a lower end terminating a second distance away from said bottom, thereby creating a channel extending along one side of said bag, and;

a second intermittent connection between said first and second sheets extending horizontally along and parallelly spaced apart from said bottom, said second intermittent connection having a first end terminating at a third distance away from said first side, and a second end terminating a fourth distance away from said second side, thereby creating a reservoir extending along said bottom of said bag.

9. The bag of claim 8, further comprising means for releasably closing off said top opening.

10. The bag of claim 8, wherein both of said sheets are substantially rectangular.

11. The bag of claim 10, wherein:

said first distance is about 0 inches;

said second distance is about 2 inches;

said third distance is about 1 inch, and;

said fourth distance is about 0 inches.

12. A device for draining vegetables and other washable goods which consists of:

two substantially symmetrical sheets of non-soluble waterproof material continuously sealed together in a face-to-face configuration along a bottom edge and two lateral edges, intermittently sealed together along a first line substantially parallel and spaced apart from said bottom edge to define a bottom reservoir, and continuously sealed together along a second line substantially parallel and spaced apart from one of said lateral edges above said first line.

13. A draining and storage bag prepared by a process comprising the steps of:

running two sheets of plastic close together in a face-to-face configuration;

heat seal stamping said bag out of said two sheets of plastic, wherein said step of heat seal stamping comprises:

sealing a bottom edge and two lateral edges, said lateral edges being connected to said bottom edge;

sealing a first line substantially parallel to and spaced apart from one of said lateral edges; and, sealing a second intermittent line substantially parallel to and spaced apart from said bottom edge; and, cutting out said bag along said bottom and lateral edges and along a top edge.

* * * * *